United States Patent [19]

Minegishi

[11] Patent Number: 4,924,827

[45] Date of Patent: May 15, 1990

[54] DIESEL ENGINE SHUT-DOWN DEVICE

[75] Inventor: Masami Minegishi, Tokyo, Japan

[73] Assignee: Fuji Jukogyo Kabushiki Kaisha, Tokyo, Japan

[21] Appl. No.: 366,677

[22] Filed: Jun. 15, 1989

[30] Foreign Application Priority Data

Jun. 24, 1988 [JP] Japan ..... 63-84353

[51] Int. Cl.[5] ..... F02B 77/08

[52] U.S. Cl. ..... 123/198 DB; 123/357; 123/373; 123/DIG. 11

[58] Field of Search ..... 123/198 D, 198 DB, 357, 123/358, 359, DIG. 11, 373

[56] References Cited

U.S. PATENT DOCUMENTS 4,124,013 11/1978 Rivalto ..... 123/198 DB
4,452,196 6/1984 Indra ..... 123/198 DB

FOREIGN PATENT DOCUMENTS 113957 7/1982 Japan ..... 123/DIG. 11

*Primary Examiner*—Noah P. Kamen
*Attorney, Agent, or Firm*—Beveridge, DeGrandi & Weilacher

[57] ABSTRACT

The shut-down device stops a diesel engine by cutting the fuel supply or the intake air supply. The device comprises a timer having a capacitor which outputs engine stop signals for a predetermined time when a key switch is turned off, and a drive element having a switching device which supplies an actuator for stopping the engine with operation signals in accordance with the engine stop signals from the capacitor. The switching device includes an NPN-type transistor to receive the engine stop signals as a base voltage and to be connected to a starter of the engine, and a PNP-type transistor to receive a divdied voltage from a battery in accordance with the starter operation and to output the operation signals to the actuator.

6 Claims, 4 Drawing Sheets

DIESEL ENGINE SHUT-DOWN DEVICE

BACKGROUND OF THE INVENTION

The present invention relates to a shut-down device for a diesel engine, and more particularly relates to a device for stopping a diesel engine by cutting the fuel supply or the intake air supply when an engine stopping command is given.

Some methods have been formerly proposed in order to stop diesel engines. One method is to cut the fuel supply by a stop lever or to stop the intake air supply by shutting a valve provided on an intake pipe.

For example, a key switch actuates a solenoid for stopping a fuel injection pump, and which is disclosed in the Japanese utility model publication No. 61-167436 and No. 61-171843 (1986) as a prior art.

According to the prior art disclosed above, the key switch must be kept in electrical contact with the accessory terminal until the diesel engine is stopped. However, it is easily forgotten to return the switch, so that the battery is unnecessarily discharged.

In order to eliminate such inconvenience described above, there has been proposed a device to stop the engine by using timer means 1 as shown in FIG. 1, which is disclosed in detail in utility model publication No. 61-164441 (1986).

Namely, a potential difference occurs in a diode bridge circuit 4 because a hydraulic switch 3 is ON during operation. A first NPN type transistor Tr1 turns on because of the connection between a key switch 2*a* and an OFF terminal during the engine stopping. An ON-operation causes a capacitor C1 to start charging and causes a PNP type transistor Tr2 and a second NPN type transistor Tr3 to turn on during the capacitor charging, so that current flows in an excitation coil 5 of a solenoid (not shown). As the solenoid operates a control rod of a fuel injection pump (neither shown) to return, the diesel engine stops because of cutting the fuel supply during a predetermined time of a time constant of the capacitor C1.

However, there remains some problems in the shut-down device of the prior art.

First, there is a problem that the capacitor C1 does not have enough time to restart the engine immediately after a stop because the capacitor C1 of the timer means 1 is fully charged immediately after the engine stops. It is therefore difficult to stop the engine again.

Second, there is a problem of interference caused at mounting a new battery to a vehicle when the battery 6 must be exchanged for a new one. Because the transistor Tr2 instantaneously turns on when new battery 6 is connected with vehicle electrical system and sparking occurs easily at the battery terminal. In this case, if the key switch 2 is turned off, a leak current occurs in the capacitor C1 and the battery 6 is discharged even when the engine stops.

Third, there is a problem of complex starting operation because the starter (not shown) must be operated until the oil pump pressure becomes high enough to turn on an oil pressure switch 3 when the necessary speed has been obtained after starting the engine.

Fourth, there is a problem of difficulty in starting the engine because of a current flowing in the excitation coil 5. Because the oil pressure switch 3 does not operate and because the first transistor Tr1 turns on despite there being no actual oil leak.

Last, there is a problem of a lowered reliability of products because of an increase in the number of causes of trouble. Since it is necessary to provide a diode bridge circuit 4 to detect the potential difference, thereby making the entire circuit more complex. Furthermore, the conventional shut-down device is suitable for general use.

SUMMARY OF THE INVENTION

An object of the present invention is to overcome the problems mentioned above.

Another object of the present invention is to provide a shut-down device for restarting a diesel engine without failure and stopping the engine again by providing a sufficient time for charging the capacitor.

The other object of the present invention is to provide a shut-down device to reduce battery power consumption when the engine stops, and to prevent an occurrence of spark when connecting the battery.

The other object of the present invention is to provide a shut-down device for simplifying the starting operation of the engine after an immediate operation of the starter.

The other object of the present invention to provide a shut-down device to improve reliability of the engine starting by preventing faults in operation.

The other object of the present invention is to provide a simple structure of the shut-down device for general purposes.

In order to accomplish the objects mentioned above, a shut-down device for a diesel engine according to the present invention comprises timer means having a capacitor which outputs an engine stopping signal during a predetermined time when a key switch is turned off, and drive means having a switching device which receives the engine stopping signal from the capacitor provided in the timer means and outputs an operation signal to an actuator for stopping the diesel engine.

According to the present invention, when the capacitor of the timer means discharges, the capacitor outputs the engine stopping signal to the diesel engine in accordance with OFF operation of the key switch by a driver, and the switching device of the drive means outputs the operation signal to the actuator for stopping the engine in accordance with the engine stopping signal. The actuator operates in accordance with the operation signal and then the diesel engine stops.

DETAILED DESCRIPTION OF THE PREFERRED EMBODIMENTS

The present invention will become understood from the following detailed description refering to the accompanying drawings.

Figure 1:
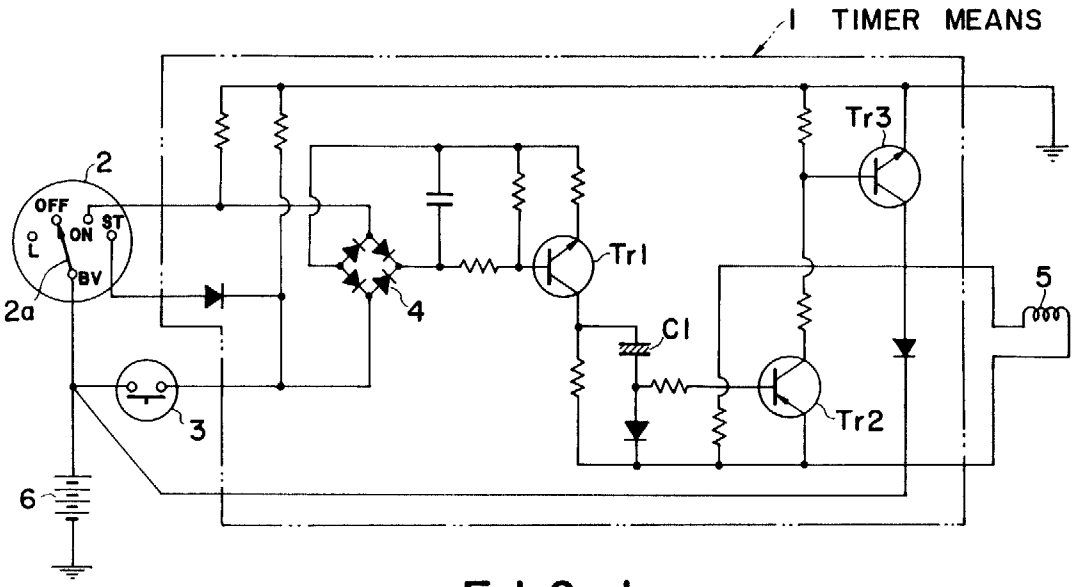
FIG. 1 PRIOR ART
FIG. 1 is a circuit diagram showing an example of a conventional shut-down device for a diesel engine.
Figure 2:
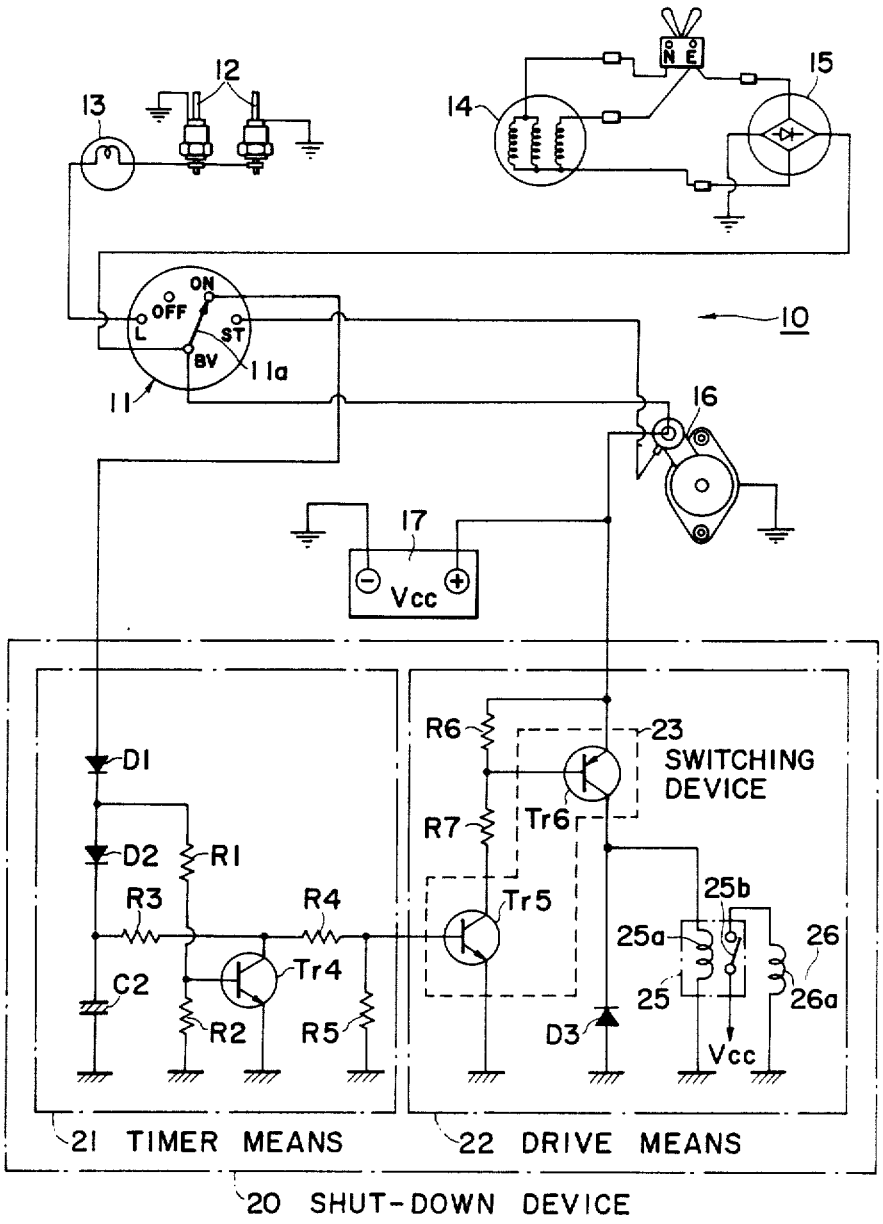
FIG. 2 is a circuit diagram showing a first embodiment of a shut-down device for a diesel engine.
Figure 3:
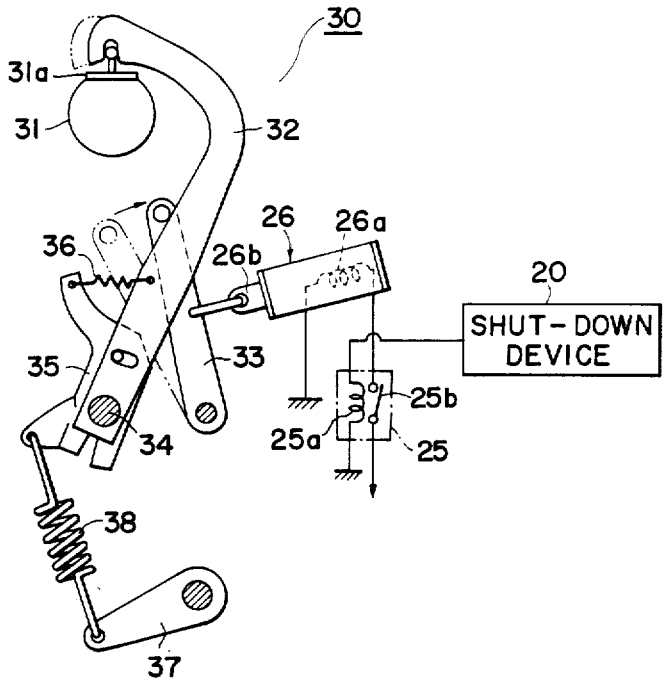
FIG. 3 is a schematic view showing a governor equipment to which the sthut-down device according to the first embodiment.
Figure 4:
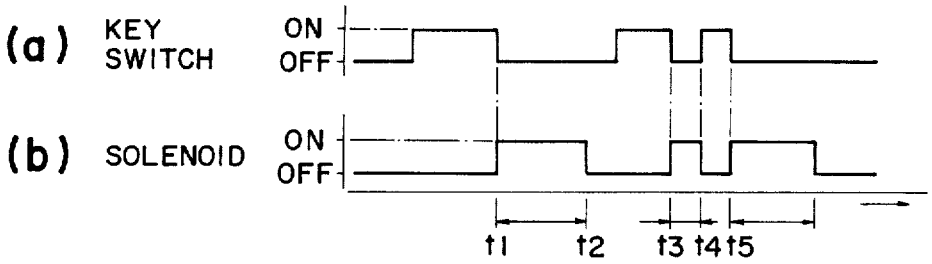
FIG. 4 is a time chart showing an operational state corresponding to an ON terminal of a key switch and a timer in the first embodiment.

FIGS. 2 to 4 show the first embodiment of a shut-down device for a diesel engine according to the present invention.

There will be described a constructure of the shut-down device for the engine according to the first embodiment refering to a circuit diagram shown in FIG. 2. In the figure, a starting apparatus 10 comprises a key switch 11, a glow plug 12, a glow lamp 13, a magnet 14, a rectifier 15, a starter 16, a battery 17, and a shut-down device 20 according to the first embodiment. The key switch 11 has a plurality of fixed contacts such as a base voltage (BV) contact for power source, an ON contact, an OFF contact, a glow plug (L) contact, a starter (ST) contact and so on, and a movable contact 11*a*. The glow plug 12 is connected to the L contact of the key switch 11 through the glow lamp 13, and the plug 12 is exposed in a combustion chamber of the diesel engine not shown in the figure. The magnet 14 is connected to the BV contact of the key switch 11 through the rectifier 15. The starter 16 is connected to the BV contact and the ST contact of the key switch 11 and also connected to the battery 17 mounted on a vehicle. The shut-down device 20 is connected to the ON contact of the key switch 11, and a connection point between the starter 16 and a positive pole of the battery 17.

The shut-down device 20 comprises timer means 21 and drive means 22.

The timer means 21 comprises a first and a second diodes D1 and D2, a first to a fifth resistors R1 to R5, a capacitor C2 and an NPN-type transistor Tr4. The diodes D1 and D2 and the capacitor C2 are connected in series between the ON contact of the switch 11 and the earth. The resistors R1 and R2 in series are connected between the connection point of the diodes D1 and D2 and the earth. The resistors R3 and R4 in series are connected between the connection point of the diode D2 and the capacitor C2 and the drive means 22. The transistor Tr4 has a base electrode connected to the connection point between the resistors R1 and R2. A collector electrode is connected to the connection point between the resistors R3 and R4, and an emitter electrode is grounded to the earth. The resistor R5 is connected in parallel to the connection point between the resistor R4 and the drive means 22.

The drive means 22 comprises an NPN-type transistor Tr5, sixth and seventh resistors R6 and R7, a PNP-type transistor Tr6, a third diode D3, a relay 25, and an excitation coil 26*a* of a solenoid 26 (not shown in FIG. 2). The transistor Tr5 has a base electrode connected to the fourth resistor R4, a collector electrode is connected to the starter 16, and an emitter electrode is grounded to the earth. The resistors R6 and R7 are connected between the starter 16 and the collector electrode of the transistor Tr5. The transistor Tr6 has a base electrode connected to a connection point of the resistors R6 and R7, and to an emitter electrode connected to the starter 16. And a collecter electrode is grounded to the earth through the diode D3. The transistors Tr5 and Tr6 comprise a switching device 23. The relay 25 is made of an excitation coil 25*a* connected between the collecter electrode of the transistor Tr6 and the earth, and a movable contact 25*b*. The excitation coil 26*a* is connected between the contact 25*b* and the earth. The solenoid including the coil 26*a* is an actuator to stop the diesel engine.

There will be described the detailed structure of a fuel system 30 including the solenoid which has the coil 26*a* with reference to FIG. 3. The system 30 comprises the solenoid 26, a fuel injection pump 31, a governor lever 32 and a stop lever 33. The solenoid 26 has a plunger 26*b* connected to a center portion of the stop lever 33. The fuel injection pump 31 is mounted on the diesel engine and has a control rack 31*a*. The control rack 31*a* regulates injection quantity of fuel by the pump 31 and is connected at an end of the governor lever 32. The governor lever 32 is rotated by the stop lever 33.

The governor lever 32 is rotatably mounted on a base end of a governor shaft 34. The stop lever 33 is actuated by the plunger 26*b* to a position shown by a solid line in FIG. 3. The governor lever 32 regulates the position of the rack 31*a* by rotation of the stop lever 33. The governor shaft 34 has a governor weight (not shown). The governor weight actuates the governor shaft 34 to rotate in the direction of low rotational speed of the engine (namely, the clockwise direction in FIG. 3). The governor lever 32 has a control link 35 and a spring 36. The lever 32 is restricted for rotating by the link 35 and the spring 36. The link 35 is joined to a control lever 37 through a governor spring 38. The position of the link 35 is regulated by rotation of the lever 37 and by urging force of the spring 38.

There will be described hereinafter an operation of the shut-down device according to the first embodiment.

When the diesel engine starts, the movable contact 11*a* touches the L contact in accordance with the operation of the key switch 11. As the L contact is connected with the glow plug 12, the glow plug 12 is heated in advance. After that, the driver operates the key switch 11 to connect the movable contact 11*a* with the ST contact. The starter 16 is actuated by this operation to start the diesel engine.

In the shut-down device 20 upon starting the diesel engine, the capacitor C2 of the timer means 21 does not yet charge a sufficient voltage to discharge, so that the relay 25 in the drive means 22 is not turned on.

After the engine starts, the movable contact 11*a* usually touches the ON contact in the key switch 11, so that the engine is driven in the ordinary state. In a normal operation, a flyweight (not shown) energizes the governor shaft 34 by centrifugal force corresponding to the speed of the engine. The control rack 31*a* of the fuel injection pump 31 is moved by balanced force between the flyweight and the governor spring 38, so that the speed of the engine is controlled at a constant state.

On the other hand, the magnet 14 generates a current. This current is charged in the battery 17 as the constant current power source $V_{cc}$ through the BV contact of the key switch 11 after connecting with the rectifier 15. At the same time, the capacitor C2 starts to be charged with electricity by the current in the timer means 21 of the shut-down device 20. The current is supplied to the transistor Tr4 as a base current, and the transistor Tr4 of the timer means 21 is turned on.

As a result, the charged current from the capacitor C2 flows to the transistor Tr4. As low-level (Lo) signals are supplied to the base electrode of the transistor Tr5 of the drive means 22, the transistor Tr5 is turned off.

Accordingly, the relay 25 of the drive means 22 is not turned on.

Next, there will be described the operation of the shut-down device when the movable contact 11*a* of the key switch 11 touches the OFF contact in order to stop the engine.

When the contact 11*a* is open, power is not supplied to the timer means 21 of the shut-down device 20. Accordingly, the transistor Tr4 is turned off, and the capacitor C2 supplies the base electrode of the transistor Tr5 with the discharged current having the time constants of the resistors R3 and R4.

The transistor Tr5 is turned on in accordance with the base current supply. By turning on the transistor Tr5, the transistor Tr5 supplies the base elctrode of the third transistor Tr6 with the low-level (Lo) signals, so that the transistor Tr6 is turned on. The battery 17 supplies the excitation coil 25*a* of the relay 25 with power when the transistor Tr6 is turned on, so that the relay contact 25*b* is turned on. Therefore, the battery 17 supplies the excitation coil 26*a* of the solenoid 26 with the discharged current.

As a 15 result, the plunger 26*b* pulls the stop lever 33 in the clockwise direction as shown in FIG. 3. The governor lever 32 also rotates in the clockwise direction. As the lever 32 is connected to the control rack 31*a* of the fuel injection pump 31, the rack 31*a* moves to restrict the fuel supply to the engine therefore stopping the engine.

Next, the transistor Tr5 is turned off when the voltage from the capacitor C2 to the base of the transistor Tr4 becomes less than the starting voltage. The solenoid 26 then returns to the position of the initial operation in accordance with stopping the current supply to the excitation coil 26*a* of the solenoid 26.

Because the shut-down device of the first embodiment described above has the solenoid 26 operated by the time constant of the resistors R3 and R4 with the discharging operation of the capacitor C2, the solenoid 26 is turned on between the time constants t1 and t2 when the driver turns off the key switch 11, as shown in FIG. 4. Furthermore, when the key switch 11 is turned on immediately (namely as a time constant t4 has passed) after it has been turned off as the time constant t3 elapses, the solenoid 26 is turned off at the same time and prepares for restarting of the engine. The capacitor C2 charges for a short time at the same time of the operation of the solenoid 26. Accordingly, when the key switch 11 is turned off again immediately after the discharging operation of the capacitor C2 (namely as a time constant t5 has passed), the solenoid 26 actuates the capacitor C2 and the resitors R3 and R4 for a time corresponding to the time constant.

Though the first embodiment is described as having the structure and the operation for stopping the engine by restricting the fuel supply, the present invention is not restricted to this structure and operation. Namely, as shown in FIGS. 5 and 6 indicating a second embodiment, the present invention stop, the engine by restricting the air supply to a combustion chamber of the engine.

Figure 5:
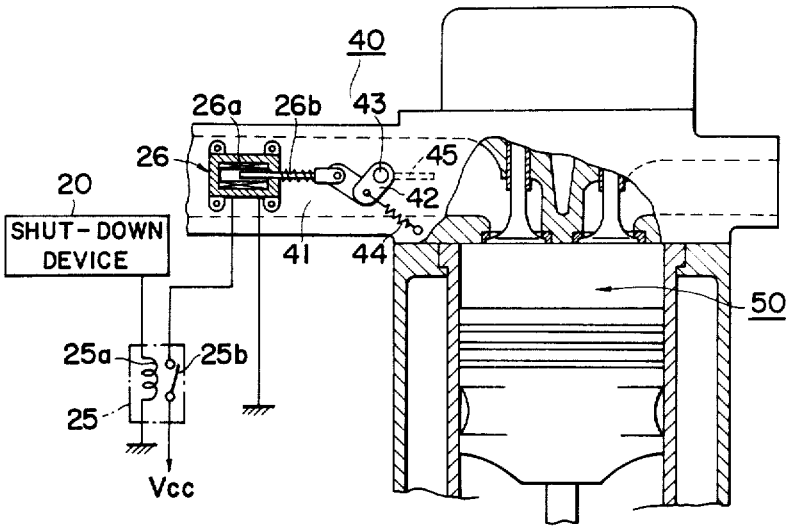
FIGS. 5 and 6 are elevational views in section showing a second embodiment according to the present invention, and explaining different states of the shutdown device, respectively, which are provided in an air suction system of the diesel engine.
Figure 6:
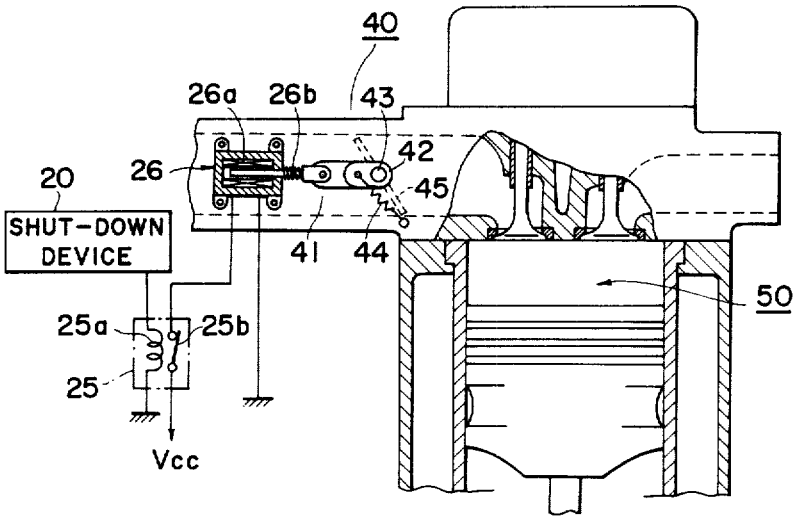

FIG. 5 indicates the same numerals for the same components of the shut-down device according to the first embodiment shown in FIGS. 2 and 3. An air suction system 40 according to the second embodiment comprises an intake pipe 41, a link 42, a shaft 43, a spring 44, and a valve 45. The solenoid 26 is installed in the intake pipe 41. The link 42 is rotatably mounted in the pipe 41 by the shaft 43, and an end of the plunger 26*b* of the solenoid 26 is fixed to the link 42. The spring 44 urges the link 42 to a predetermined direction by the predetermined urging force. The valve 45 is fixed to the link 42 and opens and shuts the intake pipe 41. A numeral 50 designates a diesel engine, and the air suction system 40 is mounted on the engine 50.

The shut-down device, which is mounted on the air suction system 40 according to the second embodiment, also has the same operation as the first embodiment. Namely, the solenoid 26 moves by driving power from the relay 25 in accordance with the operation of the timer means 21 and the drive means 22.

The valve 45 has two stopping position that are dependent on the operation of the solenoid 26. One is an open position of the valve 45 as shown in FIG. 5, and the other is a closed position of the valve 45 as shown in FIG. 6. In the open position shown in FIG. 5, when the driver turns off the key switch 11 to stop the engine, the relay 25 is turned on in accordance with the same operation of the first embodiment. Therefore, the coil 26*a* is excited and the plunger 26*b* is pulled into the solenoid 26 by the power supply from the battery 17 to the exciting coil 26*a*. When the plunger 26*b* is pulled in, the link 42 makes the valve 45 to rotate about the shaft 43 against urging force of the spring 44, so that the valve 45 shuts off the air suction pipe 41, as shown in FIG. 6.

After the key switch 11 is turned off, when the time determined by the time constants of the resistors R3 and R4 has elapsed, the relay 25 is turned off, in the same manner of the first embodiment. By this OFF-operation, the excitation current which is supplied to the coil 26*b* of the solenoid 26 is shut off, and the plunger 26*b* returns to the position shown in FIG. 5 by the urging force of the spring 44.

In this open position, when the movable contact 11a of the key switch 11 is turned on again, the timer means 21 and drive means 22 are set to the position capable of stop again. The operation thereafter is the same as the first embodiment.

The shut-down device according to the present invention is not restricted in the constructions of the first and second embodiments. For example, the present invention is applicable to not only the general diesel engines but also the diesel engine mounted on vehicles. For another example, the shut-down device of the present invention uses hydraulic actuator instead of the electromagnetic solenoid according to the first and second embodiments.

Furthermore, as a modification of the first embodiment, there may be constructed an actuator for stopping the diesel engine in the manner that the control rack 31*a* of the fuel injection pump 31 is moved in the direction of stopping the engine. The actuator is directly driven by the drive means to stop the engine.

As described above in detail, the shut-down device according to the present invention comprises a timer means having the capacitor to output the engine stop signal when the key switch is turned off, and a drive means having the switching device to output the operational signal to the actuator for the engine stop in dependency on the engine stop signal from the capacitor so as to reduce battery power consumption when the engine stops.

As sparks do not occur when a new battery is mounted, there is another effect of efficient battery mounting.

Furthermore, the present invention has a simple structure, and performs an operation for restarting and stopping diesel engine.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A diesel engine shut-down device, provided on a fuel system comprising a solenoid having an excitation coil in a cylinder and a plunger to advance from and retreat in one end of said cylinder, a fuel injection pump mounted on an engine and having a control rack to regulate an injection quantity of the pump, a governor lever rotated by a stop lever mounted on an end of said plunger, a governor shaft for rotatably supporting said governor lever and for being moved by a governor weight, a control link being rotatably supported by said shaft and pulling said governor lever by a spring, and a control lever for regulating a position of said governor lever by rotation through a second spring, comprising:

timer means for outputting an engine stop signal for a predetermined time when a key switch is turned off; and drive means for actuating said solenoid to stop the engine through a switching device in accordance with said engine stop signal from said timer means.

2. The device according to claim 1, wherein said timer means comprising, first and second diodes being connected in series and connected to an ON contact of said key switch, a capacitor being connected to said first and second diodes in series, first and second resistors in series being connected to said first and second diodes in parallel, third to fifth resistors in series being connected to said second diode and said capacitor in parallel, and an NPN-type transistor having a base electrode connected to said first and second resistors, a collector electrode connected to said third and fourth resistors, and an emitter electrode grounded to an earth.

3. The device according to claim 2;

wherein said timer means connected to the drive means having a second NPN-type transistor having a base electrode connected to said fourth and fifth resistors, a collector electrode connected to a base voltage contact of said key switch through a starter and an emitter electrode grounded to the earth, voltage divide resistors having sixth and seventh resistors and connected between said collector electrode of said second NPN-type transistor and said starter, a PNP-type transistor having a base electrode connected to said voltage divide resistors, an emitter electrode connected to a connection point of said starter and said voltage divide resistors and a collector electrode connected to the solenoid, a third diode connected to said collector electrode of said PNP-type transistor on said anode electrode and grounded to the earth on said cathode electrode, and a relay having an excitation coil connected to said PNP-type transistor and said third diode, and a relay contact connected to said solenoid.

4. The device according to claim 3, wherein said second NPN-type transistor and said PNP-type transistor consists of the switching device.

5. The device according to claim 1, wherein said switching device comprising an NPN-type transistor having a base electrode connected to an output side of said timer means, a collector electrode connected to a base contact of said key switch through a starter and an emitter electrode grounded to the earth, and a PNP-type transistor having a base electrode connected to a resistor provided between the starter and said collector electrode of said NPN-type transistor an emitter electrode connected to the starter and the voltage resistors and a collector electrode connected to said solenoid.

6. The device according to claim 5, wherein said drive means further comprising a diode connected to said collector electrode of said PNP-type transistor on an anode electrode and grounded to the earth on a cathode electrode, and a relay having an excitation coil connected to said PNP-type transistor and said diode, and a relay contact connected to said solenoid.

* * * * *